US007555414B2

(12) United States Patent
Calhoun et al.

(10) Patent No.: US 7,555,414 B2
(45) Date of Patent: Jun. 30, 2009

(54) METHOD FOR ESTIMATING CONFINED COMPRESSIVE STRENGTH FOR ROCK FORMATIONS UTILIZING SKEMPTON THEORY

(75) Inventors: William Malcolm Calhoun, The Woodlands, TX (US); Russell Thomas Ewy, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 436 days.

(21) Appl. No.: 11/015,911

(22) Filed: Dec. 16, 2004

(65) Prior Publication Data

US 2006/0131074 A1 Jun. 22, 2006

(51) Int. Cl.
*G06F 17/10* (2006.01)

(52) U.S. Cl. ..... 703/2; 703/10; 702/11

(58) Field of Classification Search ..... 703/2, 703/10; 702/9–11; 175/27, 39, 50, 57; 73/152.11
See application file for complete search history.

(56) References Cited

U.S. PATENT DOCUMENTS

| | | | |
|---|---|---|---|
| 4,981,037 | A | 1/1991 | Holbrook et al. |
| 5,205,164 | A | 4/1993 | Steiger et al. |
| 5,216,917 | A | 6/1993 | Detournay |
| 5,305,836 | A | 4/1994 | Holbrook et al. |
| 5,318,136 | A | 6/1994 | Rowsell et al. |
| 5,704,436 | A | 1/1998 | Smith et al. |
| 5,767,399 | A | 6/1998 | Smith et al. |
| 6,095,262 | A | 8/2000 | Chen |
| 6,109,368 | A | 8/2000 | Goldman et al. |
| 6,131,673 | A | 10/2000 | Goldman et al. |
| 6,167,964 | B1 | 1/2001 | Kenter et al. |
| 6,169,967 | B1 | 1/2001 | Dahlem et al. |

(Continued)

FOREIGN PATENT DOCUMENTS

| | | |
|---|---|---|
| WO | WO 01/25597 A1 | 4/2001 |

OTHER PUBLICATIONS

Jing, L. A Review of Techniques, Advances and Outstanding Issues in Numerical Modeling for Rock Mechanics and Rock Engineering, International Journal of Rock Mechanics and Mining Sciences, vol. 40, Iss. 3, Apr. 2003, pp. 283-353.*

(Continued)

*Primary Examiner*—Russell Frejd
(74) *Attorney, Agent, or Firm*—Crowell & Moring LLP

(57) ABSTRACT

A method for estimating the CCS for a rock in the depth of cut zone of a subterranean formation which is to be drilled using a drilling fluid is disclosed. An UCS is determined for a rock in the depth of cut zone. A change in the strength of the rock due to applied stresses imposed on the rock during drilling is calculated which includes estimating the ΔPP. The CCS for the rock in the depth of cut zone is calculated by adding the estimated change in strength to the UCS. The present invention calculates the ΔPP in accordance with Skempton theory where impermeable rock or soil has a change in pore volume due to applied loads or stresses while fluid flow into and out of the rock or soil is substantially non-existent. CCS may be calculated for deviated wellbores and to account for factors such as wellbore profile, stress raisers, bore diameter, and mud weight utilizing correction factors derived using computer modeling and using a baseline formula for determining an uncorrected value for CCS.

46 Claims, 9 Drawing Sheets

U.S. PATENT DOCUMENTS

| | | | | |
|---|---|---|---|---|
| 6,353,799 | B1 | 3/2002 | Meany et al. | |
| 6,374,926 | B1 | 4/2002 | Goldman et al. | |
| 6,386,297 | B1 | 5/2002 | Cooley et al. | |
| 6,408,953 | B1 | 6/2002 | Goldman et al. | |
| 6,412,577 | B1 | 7/2002 | Chen | |
| 6,612,382 | B2 | 9/2003 | King | |
| 6,631,772 | B2 | 10/2003 | Palaschenko | |
| 6,634,441 | B2 | 10/2003 | Palaschenko | |
| 2003/0015351 | A1 | 1/2003 | Goldman et al. | |
| 2003/0051918 | A1 | 3/2003 | Chen | |
| 2004/0000430 | A1 | 1/2004 | King | |
| 2006/0149478 | A1 * | 7/2006 | Calhoun et al. | 702/9 |

OTHER PUBLICATIONS

T.M. Warren et al., Bottomhole Stress Factors Affecting Drilling Rate at Depth, Journal of Petroleum Technology, Aug. 1985, pp. 1523-1533, SPE 13381.

E.C. Onyla, Relationships Between Formation Strength, Drilling Strength, and Electric Log Properties, Society of Petroleum Engineers, pp. 505-518, SPE 18166.

J.M. Cook et al., Effects of Strain Rate and Confining Pressure on the Deformation and Failure of Shale, SPE Drilling Engineering, Jun. 1991, pp. 100-103, SPE 19944.

M.R. McLean et al., Wellbore Stability: The Effect of Strength Criteria on Mud Weight Recommendations, Society of Petroleum Engineers, pp. 9-17, SPE 20405.

R.C. Pessier et al., Quantifying Common Drilling Problems with Mechanical Specific Energy and a Bit-Specific Coefficient of Sliding Friction, Society of Petroleum Engineers, pp. 373-388, SPE 24584.

J.R. Spaar et al., Formation Compressive Strength Estimates for Predicting Drillability and PDC Bit Selection, Society of Petroleum Engineers, pp. 569-578, SPE/IADC 29397.

A.W. Skempton, The Pore-Pressure Coefficients A and B, pp. 143-147.

Special Section Prestack Depth Migration, The Society of Exploration Geophysicists, ISSN 1070-485X, The Leading Edge, May 2001, vol. 20, No. 5, pp. 492-496.

John Cook et al., The Mechanics of Shales, pp. 45-56.

* cited by examiner

CONFINED COMPRESSIVE STRENGTHS (CCS)
VERSUS DIFFERENTIAL PRESSURE

Table 1. Calculated values of differential pressure, confined compressive strength, and rate of penetration.

| Depth | PP | OB | ECD | UCS | FA | $CCS_{HP}$ | $CCS_{LP}$ | $CCS_{ECD}$ | $ROP_{HP}$ | $ROP_{LP}$ | $ROP_{ECD}$ | $DP_{HP}$ | $DP_{LP}$ | $DP_{ECD}$ |
|---|---|---|---|---|---|---|---|---|---|---|---|---|---|---|
| 10,000 | 9 | 18 | 9 | 5,000 | 25 | 5,000 | 8,839 | 16,518 | 73.2 | 34.3 | 15.0 | 0 | 1,558 | 4,675 |
| 10,000 | 9 | 18 | 10 | 5,000 | 25 | 6,280 | 9,692 | 17,798 | 54.1 | 30.4 | 13.6 | 519 | 1,904 | 5,194 |
| 10,000 | 9 | 18 | 11 | 5,000 | 25 | 7,560 | 10,546 | 19,077 | 42.3 | 27.2 | 12.4 | 1,039 | 2,251 | 5,713 |
| 10,000 | 9 | 18 | 12 | 5,000 | 25 | 8,839 | 11,399 | 20,357 | 34.3 | 24.5 | 11.3 | 1,558 | 2,597 | 6,233 |
| 10,000 | 9 | 18 | 12 | 5,000 | 25 | 8,839 | 11,399 | 20,357 | 34.3 | 24.5 | 11.3 | 1,558 | 2,597 | 6,233 |
| 10,000 | 9.5 | 18 | 12 | 5,000 | 25 | 8,199 | 10,759 | 20,357 | 37.9 | 26.4 | 11.3 | 1,299 | 2,337 | 6,233 |
| 10,000 | 10 | 18 | 12 | 5,000 | 25 | 7,560 | 10,119 | 20,357 | 42.3 | 28.7 | 11.3 | 1,039 | 2,078 | 6,233 |
| 10,000 | 10.5 | 18 | 12 | 5,000 | 25 | 6,920 | 9,479 | 20,357 | 47.5 | 31.3 | 11.3 | 779 | 1,818 | 6,233 |
| 10,000 | 11 | 18 | 12 | 5,000 | 25 | 6,280 | 8,839 | 20,357 | 54.1 | 34.3 | 11.3 | 519 | 1,558 | 6,233 |

Depth, feet
PP = pore pressure, ppg
OB = Overburden, ppg
ECD = Equivalent Circulating Density, ppg
UCS = Unconfined Compressive Strength, psi
FA = Friction Angle, degrees
$CCS_{HP}$ = Confined Compressive Strength, psi, based on $DP_{HP}$
$CCS_{LP}$ = Confined Compressive Strength, psi, based on $DP_{LP}$
$CCS_{ECD}$ = Confined Compressive Strength, psi, based on $DP_{ECD}$
$ROP_{HP}$ = Rate of penetration, ft/hr, based on $CCS_{HP}$
$ROP_{LP}$ = Rate of penetration, ft/hr, based on $CCS_{LP}$
$ROP_{ECD}$ = Rate of penetration, ft/hr, based on $CCS_{ECD}$
$DP_{HP}$ = (ECD – pore pressure), psi
$DP_{LP}$ = [ECD – {PP-(OB-ECD)/3}], psi
$DP_{ECD}$ = ECD pressure, psi

FIG. 5

TABLE 2

BIT PROFILE SEGMENTS

| Inner third of bit radius | Middle third of bit radius | Outer third of bit radius |
|---|---|---|
| A | A | A |
| B | B | B |
| C | C | C |
| D | | |

FIG. 9

METHOD FOR ESTIMATING CONFINED COMPRESSIVE STRENGTH FOR ROCK FORMATIONS UTILIZING SKEMPTON THEORY

CROSS-REFERENCE TO RELATED APPLICATION

This application hereby incorporates by reference U.S. Patent Application entitled "Method for Predicting and Optimizing the Rate of Penetration in Drilling a Wellbore" by William Malcolm Calhoun, Hector Ulpiano Caicedo, and Russell Thomas Ewy, filed concurrently with the present application.

TECHNICAL FIELD

The present invention relates generally to methods for estimating rock strength, and more particularly, to methods for estimating the "confined" compressive strength (CCS) of rock formations into which wellbores are to be drilled.

BACKGROUND OF THE INVENTION

It has become standard practice to plan wells and analyze bit performance using log-based rock strength analysis. There are several methodologies in use that characterize rock strength in terms of CCS, but the most widely used standard by drill bit specialists is "unconfined" compressive strength (UCS). UCS generally refers to the strength of the rock when the rock is under only limited or uniaxial loading. The strength of the rock is typically increased when the rock is supported by confining compressive pressures or stresses from all directions. This strength is expressed in terms of CCS, which is force per unit area, i.e., pounds per square inch (psi).

The use of UCS for bit selection and bit performance prediction/analysis is somewhat problematic in that the "apparent" strength of the rock to a bit is typically something different than UCS. There is an awareness of the problem, as it is widely accepted and documented that bit performance is greatly influenced by drilling fluid pressure and the difference between drilling fluid pressure and the in situ pore pressure (PP) of the rock being drilled. The pressure provided by the drilling fluid is often referred to as the equivalent circulating density (ECD) pressure and may be expressed in terms of mud weight, i.e. pounds per gallon (ppg). For vertical wells, the drilling fluid pressure or ECD pressure replaces the overburden (OB) pressure as the overburden is drilled away from the rock.

One widely practiced and accepted "rock mechanics" method for calculating CCS is to use the following mathematical expression:

$$CCS=UCS+DP+2Dp \sin FA/(1-\sin FA) \quad (1)$$

where: UCS=the unconfined compressive strength of the rock;

DP=differential pressure (or confining stress on on the rock); and

FA=internal angle of friction of the rock or friction angle (a rock property).

Adapting equation (1) to the bottom hole drilling condition for highly permeable rock is often performed by defining the DP as the difference between the ECD pressure applied by a drilling fluid upon the rock being drilled and the in-situ PP of the rock before drilling.

This adaptation results in the following expression for the CCS for high permeability rock ($CCS_{HP}$):

$$CCS_{HP}=UCS+DP+2DP \sin FA/(1-\sin FA) \quad (2)$$

$$\text{where: } DP=ECD \text{ pressure}-\text{in situ pore pressure.} \quad (3)$$

In the case of rock which is very low in permeability, there is no industry wide standard or methodology to predict the apparent strength of the rock to the bit. There have been various schemes proposed, but the only simple methods that have gained limited acceptance assume the rock behaves as if permeable or that the PP in the rock is zero. The latter assumption results in the following mathematical expression for the $CCS_{LP}$ for low permeability rock:

$$CCS_{LP}=UCS+DP+2DP \sin FA/(1-\sin FA) \quad (4)$$

$$\text{where: } DP=ECD \text{ pressure}-0. \quad (5)$$

The assumption that PP is zero and that the differential pressure $DP_{ECD}$ is generally equal to the ECD pressure for low permeability rock often leads to erroneous estimates for the apparent $CCS_{LP}$. Subsequent use of these $CCS_{LP}$ estimates for low permeability rock then leads to poor estimates when the $CCS_{LP}$ estimates are used for bit selection, drill bit rate of penetration calculations, bit wear life predictions, and other like estimates based on the strength of the rock.

Another drawback to the above method for calculating CCS is that it fails to account for the change in the stress state of the rock for deviated or horizontal wellbores relative to vertical wellbores. Wellbores drilled at deviated angles or as horizontal wellbores can have a significantly different stress state in the depth of cut zone due to pressure applied by overburden as compared to vertical wellbores wherein the overburden has been drilled away.

Still yet another shortcoming is that CCS as calculated above is an average strength value across the bottom hole profile of a wellbore assuming that the profile is generally flat. In actuality, the bottom hole profiles of the wellbores can be highly contoured depending on the configuration of the bits creating the wellbore. Further, stress concentrations occur about the radial periphery of the hole. Highly simplified methods of calculating CCS fail to take into account these geometric factors which can significantly change the apparent strength of the rock to a drill bit during a drilling operation under certain conditions.

Accordingly, there is a need for a better way to calculate CCS for rocks subject to drilling, and more particularly, for rocks which have low permeability. The method should account for the relative change in pore pressure (ΔPP) due to the drilling operation rather than assume the PP will remain at the PP of the surrounding reservoir in the case of highly permeable rock or assume there is no significant PP in the rock for the case of very low permeability rock. The present invention addresses this need by providing improved methods for estimating CCS for low permeability rocks and for rocks that have limited permeability. Further, the present invention addresses the need to accommodate the altered stress state in the depth of cut zone found in deviated and horizontal wellbores as compared to those of vertical wellbores. Additionally, the present invention provides a way to accommodate geometric factors such as wellbore profiles and associated stress concentrations that can significantly affect the apparent CCS of rock being drilled away to create a wellbore.

SUMMARY OF THE INVENTION

The present invention includes a method for estimating the CCS for a rock in the depth of cut zone of a subterranean formation which is to be drilled using a drill bit and a drilling fluid. First, an UCS is determined for the rock. Next, the change in the strength of the rock is determined due to applied stresses which will be imposed on the rock during drilling including the change in strength due to the ΔPP in the rock due to drilling. The CCS for the rock in the depth of cut zone is then calculated by adding the estimated change in strength to the UCS. For the case of highly impermeable rock, the ΔPP is estimated assuming that there will be no substantial movement of fluids into or out of the rock during drilling. The present invention preferably calculates the ΔPP in accordance with Skempton theory where impermeable rock or soil has a change in pore volume due to applied loads or stresses while fluid flow into and out of the rock or soil is substantially non-existent.

CCS may be calculated for deviated wellbores and to account for factors such as wellbore profile, stress raisers, bore diameter, and mud weight utilizing correction factors derived using computer modeling.

For the case of a highly deviated well (>30°), well deviation, azimuth and earth principal horizontal stresses may be utilized for improved accuracy.

BRIEF DESCRIPTION OF THE DRAWINGS

FIG. 5 is a table of calculated values of DP, CCS, and rate of penetration ROP;

FIG. 9 is a table of bit profile segments which can be combined to characterize the profile of a drill bit.

DETAILED DESCRIPTION OF THE INVENTION

I. General CCS Calculation for Vertical Wellbores

An important part of the strength of a rock to resist drilling depends upon the compressive state under which the rock is subjected during drilling. This ability by a rock to resist drilling by a drill bit under the confining conditions of drilling shall be referred to as a rock's CCS. Prior to drilling, the compressive state of a rock at a particular depth is largely dependent on the weight of the overburden being supported by the rock. During a drilling operation the bottom portion of the wellbore, i.e., the rock in the depth of cut zone, is exposed to drilling fluids rather than to the overburden which has been removed. However, rock to be removed in a deviated or horizontal wellbore is still subject to components of the overburden load as well as to the drilling fluid and is dependent upon the angle of deviation of the wellbore from the vertical and also its azimuth angle.

Ideally, a realistic estimate of the in situ PP in a bit's depth of cut zone is determined when calculating CCS for the rock to be drilled. This depth of cut zone is typically on the order of zero to 15 mm, depending on the penetration rate, bit characteristics, and bit operating parameters. The present invention provides a novel way to calculate the altered PP at the bottom of the wellbore (immediately below the bit in the depth of cut zone), for rocks of limited permeability. It should be noted that the altered PP at the bottom of the hole, as it influences CCS and bit performance, is a short time frame effect, the longest time frame probably on the order of one second, but sometimes on an order of magnitude less.

Figure 1:
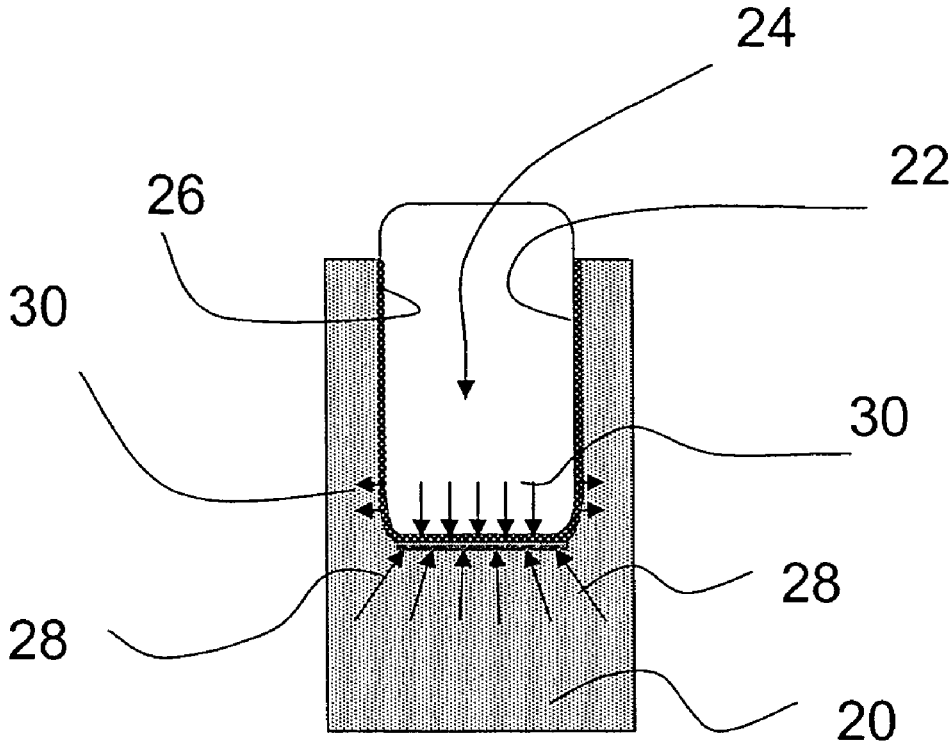
FIG. 1 is a schematic illustration of a bottom hole environment for a vertical wellbore in porous/permeable rock.

While not wishing to be held to a particular theory, the following describes the general assumptions made in arriving at a method for calculating CCS for rock being drilled using a drill bit and drilling fluid to create a generally vertical wellbore with a flat bottom hole profile. Referring now to FIG. 1, a bottom hole environment for a vertical well in a porous/permeable rock formation is shown. A rock formation 20 is depicted with a vertical wellbore 22 being drilled therein. The inner periphery of the wellbore 22 is filled with a drilling fluid 24 which creates a filter cake 26 lining wellbore 22. Arrows 28 indicate that pore fluid in rock formation 20, i.e., the surrounding reservoir, can freely flow into the pore space in the rock in the depth of cut zone. This is generally the case when the rock is highly permeable. Also, the drilling fluid 24 applies pressure to the wellbore as suggested by arrows 30.

The rock previously overlying the depth of cut zone, which exerted an "OB stress or OB pressure" prior to the drilling of the wellbore, has been replaced by the drilling fluid 24. Although there can be exceptions, the fluid pressure exerted by the drilling fluid 24 is typically greater than the in situ PP in the depth of cut zone and less than the OB pressure previously exerted by the overburden. Under this common drilling condition, the rock in the depth of cut zone expands slightly at the bottom of the hole or wellbore due to the reduction of stress (pressure from drilling fluid is less than OB pressure exerted by overburden). Similarly, it is assumed that the pore volume in the rock also expands. The expansion of the rock and its pores will result in an instantaneous PP decrease in the affected region if no fluid flows into the pores of the expanded rock in the depth of cut zone.

If the rock is highly permeable, the PP reduction results in fluid movement from the far field (reservoir) into the expanded region, as indicated by arrows 28. The rate and degree to which pore fluid flows into the expanded region, thus equalizing the PP of the expanded rock to that of the far field (reservoir pressure), is dependent on a number of factors. Primary among these factors is the rate of rock alteration which is correlative to rate of penetration and the relative permeability of the rock to the pore fluid. This assumes that the reservoir volume is relatively large compared to the depth of cut zone, which is generally a reasonable assumption. At the same time, if drilling fluid or ECD pressure is greater than in situ PP, filtrate from the drilling fluid will attempt to enter the permeable pore space in the depth of cut zone. The filter cake 26 built during the initial mud invasion (sometimes referred to as spurt loss) acts as a barrier to further filtrate invasion. If the filter cake 26 build up is efficient, (very thin and quick, which is desirable and often achieved) it is reasonable to assume that the impact of filtrate invasion on altering the PP in the depth of cut region is negligible. It is also assumed that the mud filter cake 26 acts as an impermeable membrane for the typical case of drilling fluid pressure being greater than PP. Therefore, for highly permeable rock drilled with drilling fluid, the PP in the depth of cut zone can reasonably be assumed to be essentially the same as the in-situ PP of the surrounding reservoir rock.

For substantially impermeable rock, such as shale and very tight non-shale, it is assumed that there is no substantial amount of pore fluid movement or filtrate invasion into the depth of cut zone. Therefore, the instantaneous PP in the depth of cut zone is a function of the stress change on the rock in the depth of cut zone, rock properties such as permeability and stiffness, and in-situ pore fluid properties (primarily compressibility).

As described above in the background section, equation (1) represents a widely practiced and accepted "rock mechanics" method for calculating CCS of rock.

$$CCS=UCS+DP+2DP\sin FA/(1-\sin FA) \quad (1)$$

where: UCS=rock unconfined compressive strength;

DP=differential pressure (or confining stress) across the rock; and

FA=internal angle of friction of the rock.

In the preferred and exemplary embodiment of the present invention, the UCS and internal angle of friction FA is calculated by the processing of acoustic well log data or seismic data. Those skilled in the art will appreciate that other methods of calculating UCS and internal angle of friction FA are known and can be used with the present invention. By way of example, and not limitation, these alternative methods of determining UCS and FA include alternative methods of processing of well log data, and analysis and/or testing of core or drill cuttings.

Details regarding the internal angle of friction can be found in U.S. Pat. No. 5,416,697, to Goodman, entitled "Method for Determining Rock Mechanical Properties Using Electrical Log Data", which is hereby incorporated by reference in its entirety. Goodman utilizes a method for determining the angle of internal friction disclosed by Turk and Dearman in 1986 in "Estimation of Friction Properties of Rock From Deformation Measurements", Chapter 14, Proceedings of the $27^{th}$ U.S. Symposium on Rock Mechanics, Tuscaloosa, Ala., Jun. 23-25, 1986. The method predicts that as Poisson's ratio changes with changes in water saturation and shaliness, the angle of internal friction changes. The angle of internal friction is therefore also related to rock drillability and therefore to drill bit performance. Adapting this methodology to the bottom hole drilling conditions for permeable rock is accomplished by defining DP as ECD pressure minus the in-situ PP of the rock before drilling or the PP of the surrounding reservoir rock at the time of drilling. This results in the mathematical expressions for $CCS_{HP}$ and DP as described above with respect to equations (2) and (3).

Figure 2A:
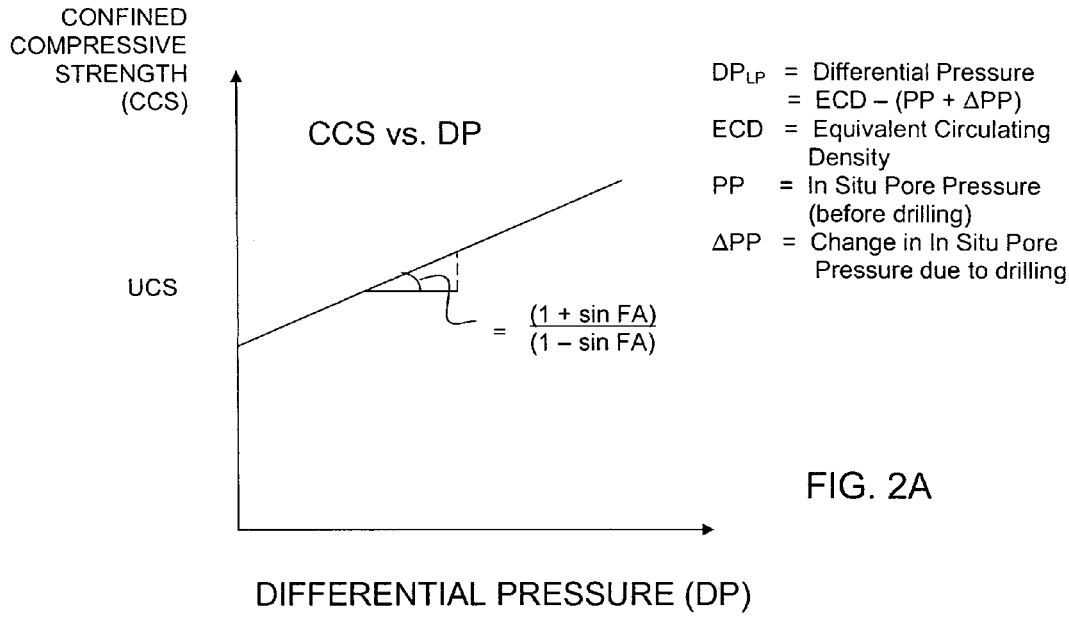
FIGS. 2A and 2B are graphs of CCS plotted against the confining or DP applied across a rock in the depth of cut zone.
Figure 2B:
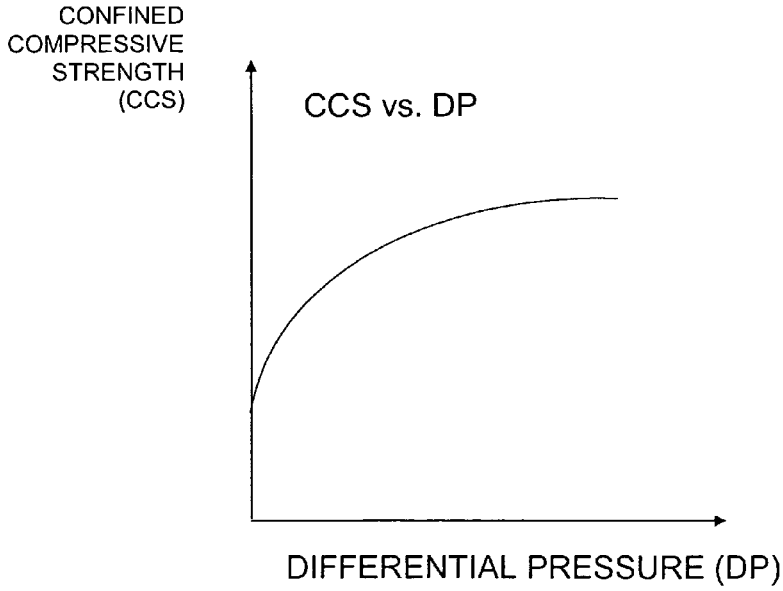

ECD pressure is most preferably calculated by directly measuring pressure with down hole tools. Alternatively, ECD pressure may be estimated by adding a reasonable value to mud pressure or calculating with software. FIGS. 2A and 2B depict exemplary graphs showing how CCS varies with the DP applied across the rock in the depth of cut zone. With no DP applied across the rock, the strength of the rock is essentially the UCS. However, as the DP increases, the CCS also increases. In FIG. 2A, the increase is shown as a linear function. In FIG. 2B, the increase is shown as a non-linear function.

Rather than assuming the PP in low permeability rock is essentially zero, the present invention utilizes a soil mechanics methodology to determine the ΔPP and applies this approach to the drilling of rocks. For the case of impermeable rock, a relationship described by Skempton, A. W.: "Pore Pressure Coefficients A and B," *Geotechnique* (1954), Volume 4, pages 143-147 is adapted for use with equation (1). Skempton pore pressure may generally be described as the in-situ PP of a porous but generally non-permeable material before drilling modified by the PP change ΔPP due to the change in average stress on a volume of the material assuming that permeability is so low that no appreciable flow of fluids occurs into or out of the material. In the present application, the porous material under consideration is the rock in the depth of cut zone and it is assumed that that permeability is so low that no appreciable flow of fluids occurs into or out of the depth of cut zone. It is noted in FIG. 2A, that the change ΔPP in DP is a function of the PP change in the rock due to drilling).

This DP across the rock in the depth of cut zone may be mathematically expressed as:

$$DP_{LP}=ECD-(PP+\Delta PP) \quad (6)$$

where: DP=differential pressure across the rock for a low permeability rock;

ECD=equivalent circulating density pressure of the drilling fluid;

(PP+ΔPP)=Skempton pore pressure;

PP=pore pressure in the rock prior to drilling; and

ΔPP=change in pore pressure due to ECD pressure replacing earth stress.

Figure 3:
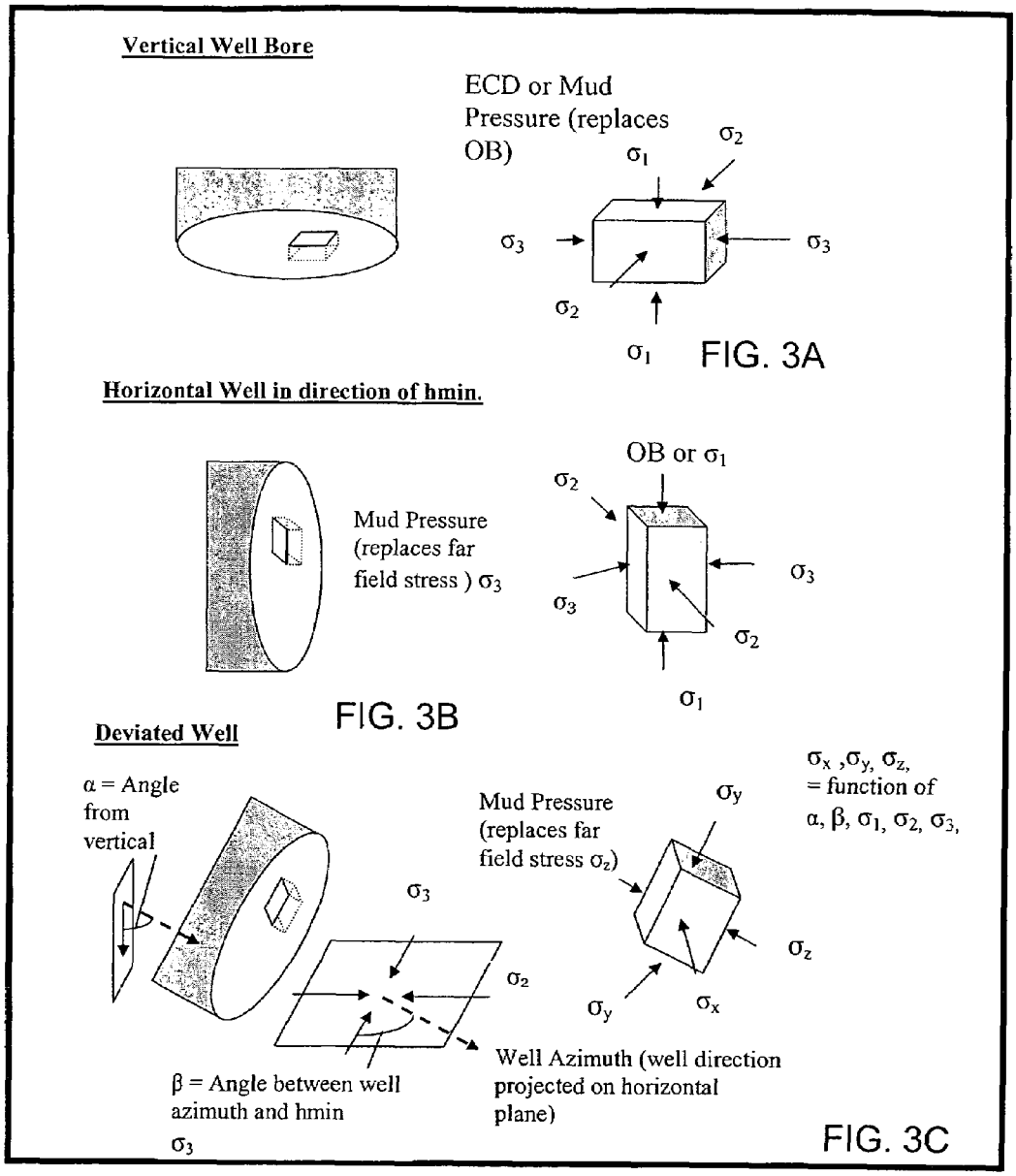
FIGS. 3A, 3B, and 3C are schematic illustrations of stresses applied to stress blocks of rock in the depth of cut zone for a) a vertical wellbore; b) a horizontal wellbore; and c) a wellbore oriented at an angle a deviating from the vertical and at an azimuthal angle β, respectively.

FIG. 3A shows principal stresses applied to a stress block of rock from the depth of cut zone for a generally vertical wellbore. Note that ECD pressure replaces OB pressure as a consequence of the rock being drilled. FIG. 3B illustrates a stress block of rock from a generally horizontally extending portion of a wellbore. In this case, OB pressure remains on the vertical surface of the stress block. FIG. 3C shows a stress block of rock obtained from a deviated wellbore having an angle α of deviation from the vertical and an azimuthal angle β projected on a horizontal plane. Mud or ECD pressure replaces the previous pressure or stress that existed prior to drilling in the direction of drilling (z direction).

Skempton describes two PP coefficients A and B, which determine the ΔPP caused by changes in applied total stress for a porous material under conditions of zero drainage. The ΔPP is given the general case by:

$$\Delta PP=B[(\Delta\sigma_1+\Delta\sigma_2+\Delta\sigma_3)/3+\sqrt{\tfrac{1}{2}[(\Delta\sigma_1-\Delta\sigma_2)^2+(\Delta\sigma_1-\Delta\sigma_3)^2+(\Delta\sigma_2-\Delta\sigma_3)^2]}*(3A-1)/3] \quad (7)$$

where: A=coefficient that describes change in pore pressure caused by change in shear stress;

B=coefficient that describes change in pore pressure caused by change in mean stress;

$\sigma_1$=first principal stress;

$\sigma_2$=second principal stress;

$\sigma_3$=third principal stress; and

Δ=operator describing the difference in a particular stress on the rock before drilling and during drilling.

For a generally vertical wellbore, the first principal stress $\sigma_1$ is the OB pressure prior to drilling which is replaced by the ECD pressure applied to the rock during drilling, and $\sigma_2$ and $\sigma_3$ are horizontal principal earth stresses applied to the rock. Also, $(\Delta\sigma_1+\Delta\sigma_2+\Delta\sigma_3)/3$ represents the change in average, or mean stress, and $$\sqrt{\tfrac{1}{2}[(\Delta\sigma_1-\Delta\sigma_2)^2+(\Delta\sigma_1-\Delta\sigma_3)^2+(\Delta\sigma_2-\Delta\sigma_3)^2]}$$

represents the change in shear stress on a volume of material.

For an elastic material it can be shown that A=⅓. This is because a change in shear stress causes no volume change for an elastic material. If there is no volume change then there is no PP change (the pore fluid neither expands nor compresses). If it is assumed that the rock near the bottom of the hole is deforming elastically, then the PP change equation (7) can be simplified to:

$$\Delta PP=B(\Delta\sigma_1+\Delta\sigma_2+\Delta\sigma_3)/3. \quad (8)$$

For the case where it is assumed that $\sigma_2$ is generally equal to $\sigma_3$, then $$\Delta PP=B(\Delta\sigma_1+2\Delta\sigma_3)/3. \quad (9)$$

Equation (8) describes that PP change ΔPP is equal to the constant B multiplied by the change in mean, or average, total stress on the rock. Note that mean stress is an invariant property. It is the same no matter what coordinate system is used. Thus the stresses do not need to be principal stresses. Equation (8) is accurate as long as the three stresses are mutually perpendicular. For convenience, $\sigma_Z$ will be defined as the stress acting in the direction of the wellbore and $\sigma_X$ and $\sigma_Y$ as stresses acting in directions mutually orthogonal to the direction of the wellbore. Equation (8) can then be rewritten as:

$$\Delta PP=B(\Delta\sigma_Z+\Delta\sigma_X+\Delta\sigma_Y)/3. \quad (10)$$

There will be changes in $\sigma_X$ and $\sigma_Y$ near the bottom of the hole. However, these changes are generally small when compared to $\Delta\sigma_Z$ and can be neglected for a simplified approach. Equation (10) then simplifies to $$\Delta PP=B(\Delta\sigma_Z)/3. \quad (11)$$

For most shales, B is between 0.8 and ~1.0. Young, soft shales have B values of 0.95 to 1.0, while older stiffer shales will be closer to 0.8. For a simplified approach that does not require rock properties, it is assumed that B=1.0. Since $\Delta\sigma_Z$ is equal to (ECD−$\sigma_Z$) for a vertical wellbore, equation (11) can be rewritten as $$\Delta PP=(ECD-\sigma_Z)/3. \quad (12)$$

Note that ΔPP is almost always negative. That is, there will be a PP decrease near the bottom of the hole due to the drilling operation. This is because ECD pressure is almost always less than the in situ stress parallel to the well ($\sigma_z$) prior to drilling.

The altered PP (Skempton pore pressure) near the bottom of the hole is equal to PP+ΔPP, or PP+(ECD−$\sigma_Z$)/3. This can also be expressed as:

$$PP-(\sigma_Z-ECD)/3. \quad (13)$$

For the case of a vertical well, $\sigma_Z$ is equal to the OB stress or OB pressure which is removed due to the drilling operation.

In the case of a vertical well and most shale (not unusually hard and stiff), the change in average stress can be approximated by the term "(OB−ECD)/3".

Utilizing this assumption, the following expression can be used for generally vertical wellbores wherein low permeability rock is being drilled:

$$CCS_{LP}=UCS+DP+2DP\sin FA/(1-\sin FA) \quad (14)$$

$$\text{where: } DP=ECD \text{ pressure}-\text{Skempton Pore Pressure} \quad (15)$$

$$\text{Skempton Pore Pressure}=PP-(OB-ECD)/3 \quad (16)$$

where: OB=overburden pressure or stress $\sigma_Z$ in the z-direction; and

PP=in situ pore pressure.

OB pressure is most preferably calculated by integrating rock density from the surface (or mud line or sea bottom for a marine environment). Alternatively, OB pressure may be estimated by calculating or assuming average value of rock density from the surface (or mud line for marine environment). In this preferred and exemplary embodiment of this invention, equations (2) and (14) are used to calculate CCS for high and low permeability rock, i.e. "$CCS_{HP}$" and "$CCS_{LP}$". For intermediate values of permeability, these values are used as "end points" and "mixing" or interpolating between the two endpoints is used to calculate CCS for rocks having an intermediate permeability between that of low and high permeability rock. As permeability can be difficult to determine directly from well logs, the present invention preferably utilizes effective porosity $\phi_e$. Effective porosity $\phi_e$ is defined as the porosity of the non-shale fraction of rock multiplied by the fraction of non-shale rock. Effective porosity $\phi_e$ of the shale fraction is zero. It is recognized that permeability can be used directly when/if available in place of effective porosity in the methodology described herein.

Although there are exceptions, it is believed that effective porosity $\phi_e$ generally correlates well with permeability and, as such, effective porosity threshold $\phi_e$ is used as a means to quantify the permeable and impermeable endpoints. The following methodology is preferably employed to calculate "$CCS_{MIX}$", the CCS of the rock to the drill bit:

$$CCS_{MIX}=CCS_{HP} \text{ if } \phi_e\geqq\phi_{HP}, \quad (17)$$

$$CCS_{MIX}=CCS_{LP} \text{ if } \phi_e\leqq\phi_{LP}, \quad (18)$$

$$CCS_{MIX}=CCS_{LP}\times(\phi_{HP}-\phi_e)/(\phi_{HP}-\phi_{LP})+CCS_{HP}\times(\phi_e-\phi_{LP})/(\phi_{HP}-\phi_{LP}) \text{ if } \phi_{LP}\leqq\phi_e\leqq\phi_{HP}; \quad (19)$$

where: $\phi_e$=effective porosity;

$\phi_{LP}$=low permeability rock effective porosity threshold; and $\phi_{HP}$=high permeability rock effective porosity threshold.

In this exemplary embodiment, a rock is considered to have low permeability if it's effective porosity $\phi_e$ is less than or equal to 0.05 and to have a high permeability if its effective porosity $\phi_e$ is equal to or greater than 0.20. This results in the following values of $CCS_{MIX}$ in this preferred embodiment:

$$CCS_{MIX}=CCS_{HP} \text{ if } \phi_e\geqq0.20; \quad (20)$$

$$CCS_{MIX}=CCS_{LP} \text{ if } \phi_e\leqq0.05; \quad (21)$$

$$CCS_{MIX}=CCS_{LP}\times(0.20-\phi_e)/0.15+CCS_{HP}\times(\phi_e-0.05)/0.15 \text{ if } 0.05<\phi_e<0.20. \quad (22)$$

As can be seen from the equations above, the assumption is made that the rock behaves as impermeable if $\phi_e$ is less than or equal to 0.05 and as permeable if $\phi_e$ is greater than or equal to 0.20. The endpoint $\phi_e$ values of 0.05 and 0.20 are assumed, and it is recognized that reasonable endpoints for this method are dependent upon a number of factors including the drilling rate. Those skilled in the art will appreciate that other endpoints may be used to define the endpoints for low and high permeability. Likewise, it will be appreciated that non-linear interpolation schemes can also be used to estimate $CCS_{MIX}$ between the endpoints. Further, other schemes of calculating $CCS_{MIX}$ for a range of permeabilities may be used which rely, in part, upon the Skempton approach described above for calculating PP change ΔPP which is generally mathematically described using equations (7)-(12).

Support for the methodology utilizing the Skempton approach for determining $CCS_{LP}$ for low permeability rock is provided by computer models and from experimental data. Warren, T. M., Smith, M. B.: "Bottomhole Stress Factors Affecting Drilling Rate at Depth," *J. Pet. Tech.* (August 1985) 1523-1533, hereinafter referred to as Warren and Smith, describes results of finite element or computer modeling of the bottom of a hole. This work supports the concept that the effective stress on the bottom of the hole for permeable rock is essentially equal to the difference between drilling fluid ECD pressure and in-situ PP for the reasons described above, except for minor differences due to the bottom hole profile and larger differences near the-diameter due to an edge effect.

Figure 4:
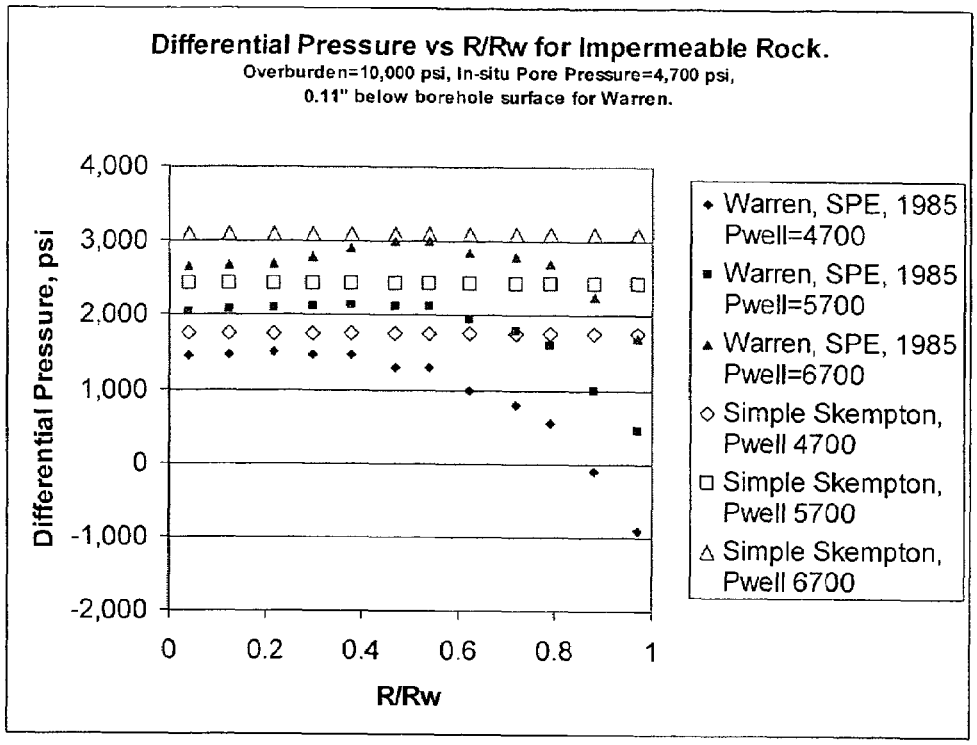
FIG. 4 is a graph showing DP at the bottom of a hole for impermeable rock as predicted in accordance with the present invention and as estimated by a finite element computer model.

FIG. 4 illustrates the DP for a given set of conditions for impermeable rock. Shown are DP curves determined by the finite element modeling of Warren and Smith, as well as by using the simplified Skempton method of the present invention, i.e. using equations (14)-(16). These results are for the cases where OB pressure equals 10,000 psi, horizontal stresses $\sigma_X$, $\phi_Y$ equals 7,000 psi, in situ PP equals 4,700 psi, and mud pressure (PWell) or $ECD_{Pressure}$ equals 4,700, 5,700 and 6,700 psi, respectively. The Warren and Smith results are provided for 0.11" below the bottom of the borehole surface and at various radial positions R from the center of the hole of overall radius $R_W$. Additional rock properties, pore fluid properties, and bottom hole profile were required for Warren and Smith's finite element analysis. As can be seen, there is fair agreement between-Warren and Smith's more rigorous finite element modeling and the simplified Skempton approvals presented herein. The agreement would be even better for a more typical shale, as Warren and Smith modeled a very hard, stiff shale. It is also noteworthy that the apparent difference between the two methods decreases as mud or ECD pressure increases above in-situ PP. Therefore the simplified method of the present invention may be particularly-suitable and accurate for more over-balanced conditions and then become less accurate as balanced conditions are approached.

If a rock formation has a coefficient B of less than one, then the error due to assuming B=1 will cause a slight over-prediction of the amount of PP decrease ΔPP. This over-prediction is evident in FIG. 4 wherein results are shown from the finite element model for a shale that is extremely hard and stiff (B=0.57). For a more typical shale B value the calculated DP values would be about 500 psi higher, which would match extremely well with the simplified Skempton calculations used in the present invention. A more robust application of this Skempton based approach would include calculating values of A and B coefficients based on log-derived rock properties, and also to account for changes in $\sigma_X$, $\sigma_Y$ and $\sigma_z$ if necessary.

For the case of a very stiff, but very low-permeability rock, such as a very tight carbonate, B is likely to be much less than 1.0 and could easily be on the order of 0.5. The actual value of B should therefore be taken into account for tight non-shale lithologies. Extremely stiff shales may also require adjustment of the B value.

If the stress change that occurs near the bottom of the hole is enough to cause non-elastic behavior (due to increasing shear stress), this can be accounted for by using the appropriate value of A, instead of assuming A=⅓. In a more advanced approach, the A coefficient can even be used to represent instantaneous PP changes ΔPP that occur in the rock as it is being cut and failed by the bit. These PP changes ΔPP are a function of whether the rock is failing in a dilatant or non-dilatant manner, and can also exhibit strain-rate effects at high strain rates. See Cook, J. M., Sheppard, M. C., Houwen, O. H.: "Effects of Strain Rate and Confining Pressure on the Deformation and Failure of Shale," paper *IADC/SPE* 19944, presented at 1990 IADC/SPE Drilling Conference, Feb. 27-Mar. 2, 1990, Houston, Tex. Cunningham, R. A., Eenink, J. G.: "Laboratory Study of Effect of Overburden, Formation and Mud Column Pressures on Drilling Rate of Permeable Formations," *J. Pet. Tech.* (January 1959), pages 9-15 includes lab test data describing the effect of mud confining pressure on the drill rate of rock samples. If rock properties and confining stress are known, the CCS of the rock can be calculated for each test condition. Rate of penetration ROP versus CCS can then be plotted and the relationship between ROP and CCS established. An example, using the lab test data of Cunningham et al., is shown in FIG. 6.

Figure 6:
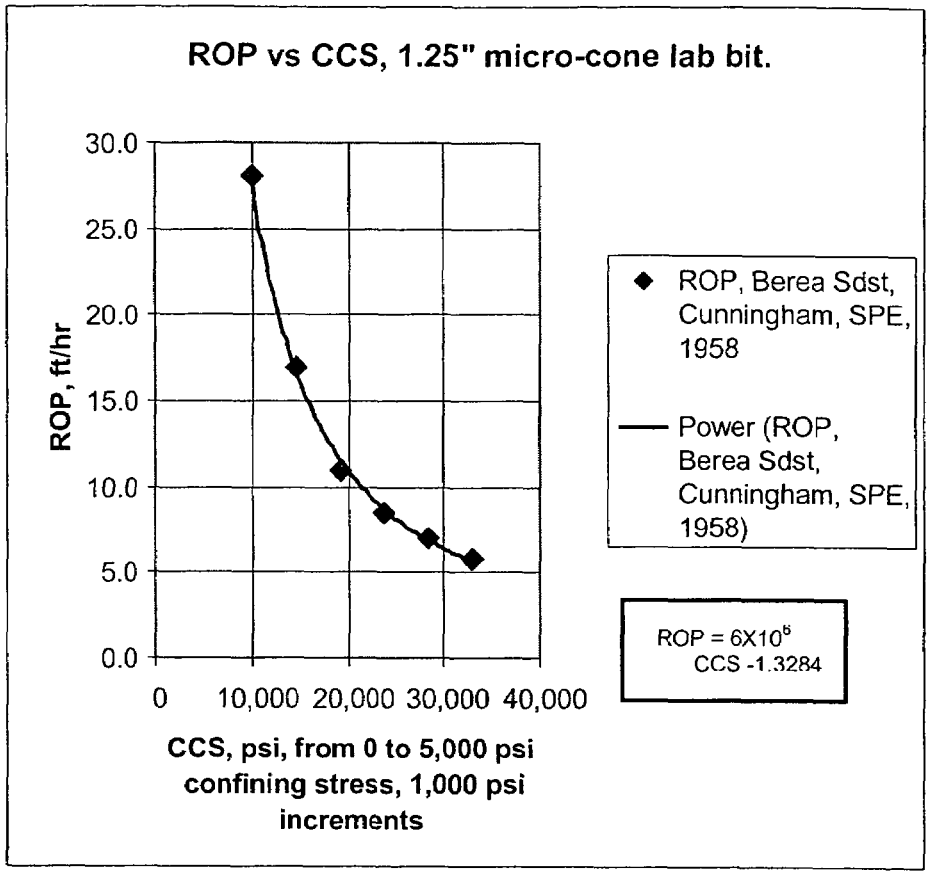
FIG. 6 is a graph of rate of penetration ROP for a drill bit versus CCS of a rock being drilled.

The ROP verses CCS curve in FIG. 6 is typical, and data from numerous drilling operations around the world suggests that a power function be used as an optimal generalized function to describe the curve. For the specific test data, a power law trend line is matched to the data and the resulting trend line formula is indicated in FIG. 6, as:

$$ROP=6\times10^{6}\,CCS^{-1.3284} \tag{23}$$

It should be noted that the ROP formula of equation (23), is specific to a lab 1.25" micro-bit and drilling parameters (weight on bit, rpm, flow rate, etc.)

Figure 7:
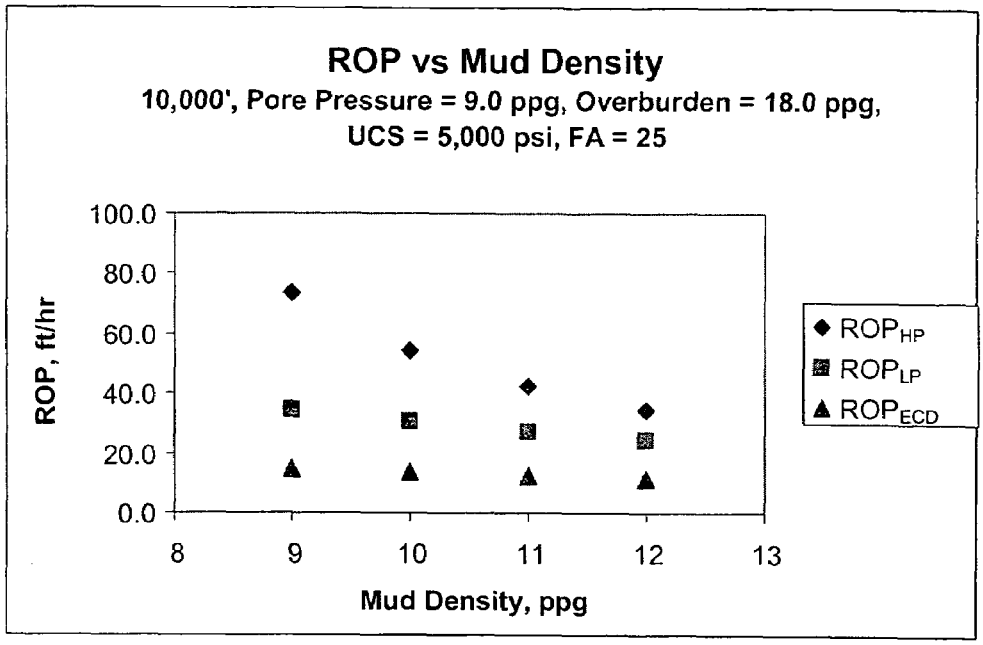
FIG. 7 is a graph of rate of penetration ROP versus mud density.
Figure 8:
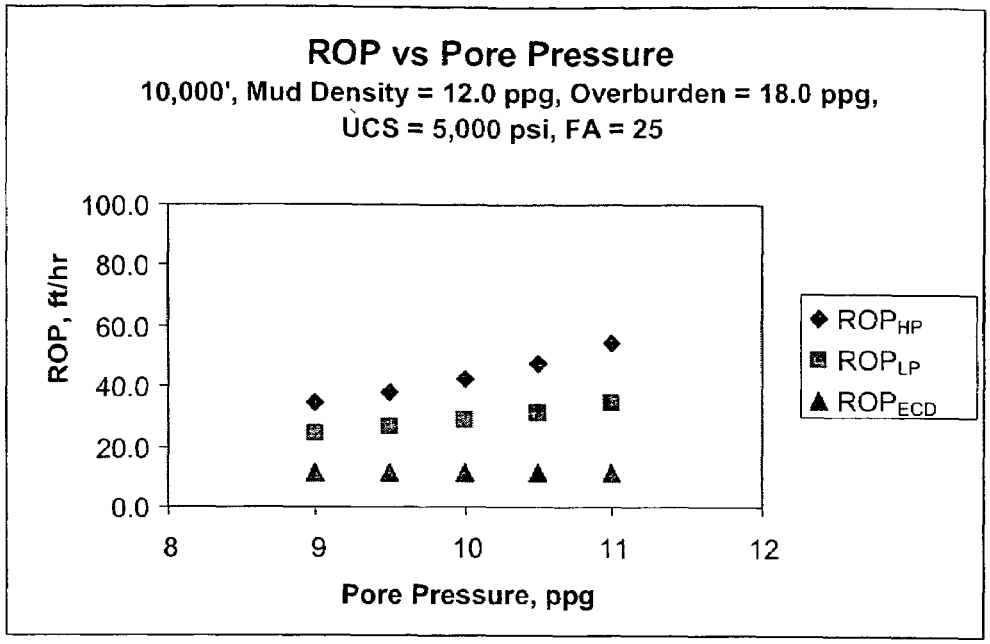
FIG. 8 is a graph of rate of penetration ROP versus PP.

Table 1 utilizes equation (23) and CCS values based upon 1) DP ($CCS_{HP}$); 2) Skempton pore pressure ($CCS_{LP}$); and 3) ECD pressure ($CCS_{ECD}$). Some results utilizing equation (23) are shown in Table 1, and also in FIGS. 7 and 8. In FIG. 7, the example is for a well 10,000 feet deep, the rock having a PP of 9.0 ppg, an overburden load of 18.0 ppg, an UCS of 5,000 psi, and a friction angle FA of 25°, and calculated ROP is shown as mud density is varied from 9.0 to 12.0 ppg. In FIG. 8, the same conditions are applied, but mud density is assumed fixed at 12.0 ppg and the PP is varied from 9.0-11.0 ppg.

The data from Table 1 and FIGS. 7 and 8 indicate that using absolute ECD pressure for calculating CCS yields unrealistically high values of CCS and produces no or very little ROP response. This is inconsistent with actual field experience. The ROP response based on $CCS_{HP}$ calculated from straight DP or Skempton based differential pressure $DP_{LP}$ yield more realistic results. This further validates the approach of using CCS based on straight differential pressure $DP_{HP}$ or Skempton differential pressure $DP_{LP}$ rather than absolute ECD pressure, as some have proposed as the preferred way to model low permeability rock.

The angle of internal friction FA may also change as confining stress changes. This is due to what is known in rock mechanics as a curved failure envelope (see FIG. 2B). The net effect is that at high confining stress (for example, >5,000 psi), some rocks exhibit less and less increase in confined strength as confining stress increases, and some rocks reach a peak confined strength which doesn't increase with further increase in confining stress. This condition would obviously present error to the methodology presented by this invention if friction angle FA is taken as a constant. The degree to which friction angle FA changes as confining stress changes varies with rock type and rock properties within a type. When the change in friction angle FA with change in confining stress is significant, then the friction angle FA should be modified to be a function of the confining stress.

The preferred and exemplary method of the present invention does not require lithology. For bit selection or bit performance modeling, lithology is commonly a required specification to those skilled in the art. The methodology presented herein assumes that UCS and FA represent the dominant influencing rock properties and, therefore, lithology specification is not required.

Rock stiffness, porosity and pore fluid compressibility influence the amount of PP change ΔPP that occurs when impermeable rock expands. The simplistic Skempton model presented above for impermeable rock does not take these factors directly into account. They can be accounted for by the Skempton "A" and "B" coefficients. The error introduced by not accounting for these factors is relatively small for most shales. The error will be relatively small whenever rock compressibility is significantly greater than pore fluid compressibility. This is the case for most shales which are not hard and stiff and which contain water as the pore fluid. The error may become significant when shale is hard and stiff. In this case the PP drop will be overpredicted and the DP will be overpredicted. Over-prediction is also likely for very tight, stiff carbonates. This error can be removed by adjusting the "B" coefficient to account for rock stiffness, and if necessary, porosity and pore fluid compressibility.

II. Deviated and Horizontal Wellbores

In the case of a deviated well, the earth stress that existed normal to the bottom of the hole and prior to the existence of the hole is substituted for overburden in all the equations above. The earth stress that existed normal to the bottom of the hole is a component of overburden and horizontal stresses, $\sigma_{2\ and}\ \sigma_3$. Earth horizontal stress is typically characterized as two principal horizontal stresses. Earth principal horizontal stresses are typically less than overburden, except in the existence of tectonic force which can cause the maximum principal horizontal stress to be greater than overburden. For competent rock in a non-tectonic environments, horizontal effective stress is typically on the order of ¼ to ¾ of effective OB stress, but in very pliable and/or plastic rock the effective horizontal stress can approach or equal overburden. It should be noted that the stress blocks and stresses applied on these blocks are greatly simplified, ignoring factors like edge effects and the true 3D nature of bottom hole stresses. These effects shall be described in the next section.

A simplified Skempton approach to a deviated wellbore may be derived assuming 1) rock is elastic (A=⅓) 2) $\Delta\sigma_X$, $\Delta\sigma_Y$ are small; and B≈1.0. Mathematically, $CCS_{LP}$ for a deviated wellbore in a low permeability rock formation may be calculated using the following formula:

$$CCS_{LP}=UCS+DP+2DP\sin FA/(1-\sin FA); \quad (14)$$

$$\text{where: } DP=ECD \text{ pressure}-\text{Skempton Pore Pressure}; \quad (15)$$

$$\text{Skempton Pore Pressure}=PP-(\sigma_z-ECD)/3; \quad (16)$$

where: $\sigma_z$=in situ stress parallel to well axis, before well is drilled; and PP=in situ pore pressure.

Alternatively, Skempton Pore Pressure can be calculated using change in average stress in an orthogonal system.

$$\text{Skempton Pore Pressure}=PP+B(ECD-\sigma_Z+\Delta\sigma_X+\Delta\sigma_Y)/3; \quad (24)$$

A more general equation corresponding to equation (7) can be utilized for the cases of deviated wellbores in which the stress parallel to the well is not a principal stress, and if A cannot be assumed to be equal to ⅓. More particularly, in an x, y, z reference frame where x, y and z are not principal directions of stress as seen in FIG. 3C:

$$\Delta PP = B\left[(\Delta\sigma_x+\Delta\sigma_y+\Delta\sigma_z)/3+\sqrt{\frac{1}{2}[(\Delta\sigma_x-\Delta\sigma_y)^2+(\Delta\sigma_x-\Delta\sigma_z)^2+(\Delta\sigma_y-\Delta\sigma_z)^2]+3\Delta\tau_{xy}^2+3\Delta\tau_{yz}^2+3\Delta\tau_{xz}^2}*(3A-1)/3\right]; \quad (25)$$

where A=Skempton coefficient that describes change in pore pressure caused by change in shear stress on the rock;

B=Skempton coefficient that describes change in pore pressure caused by change in mean stress on the rock;

Δ=operator describing the difference in a particular stress on the rock before drilling and during drilling.

$\sigma_x$=stress in the x-direction;

$\sigma_y$=stress in the y-direction; and $\sigma_z$=stress in the z-direction;

$\tau_{xy}$=shear stress in the x-y plane;

$\tau_{yz}$=shear stress in the y-z plane; and $\tau_{xz}$=shear stress in the x-z plane.

The above stress values can be determined by transposing the in-situ stress tensor relative to a coordinate system with one axis parallel to the wellbore and another axis which lies in a plane perpendicular to axis of wellbore. Earth principal stresses $\sigma_1$, overburden, may be obtained from density log data or other methods of estimation of subsurface rock density. $\sigma_2$, intermediate earth principal stress or maximum principal horizontal stress, is typically calculated based on analysis of well breakouts from image logs, rock properties, wellbore orientation, and assumptions (or determination) of $\sigma_1$ and $\sigma_3$. $\sigma_3$, minimum earth stress or minimum principal horizontal stress, is typically directly measured by fracturing wells at multiple depths or it can be calculated from $\sigma_1$, rock properties, and assumptions of earth stress history and present day earth stresses. Principal stresses $\sigma_1$, $\sigma_2$, and $\sigma_3$ may be obtained from various data sources including well log data, seismic data, drilling data and well production data. Such methods are familiar to those skilled in the art.

A transpose may be used to convert principal stresses to another coordinate system including normal stresses and shear stresses on a stress block. Such transposes are well known by those skilled in the art. As an example, a transpose may be used in the present invention which is described by M. R. McLean and M. A. Addes, in "Wellbore Stability: The Effect of Strength Criteria on Mud Weight Recommendations" *SPE* 20405 (1990). FIG. 4 of this publication shows the transpose of in-situ stress state in a stress block with appropriately labeled normal and shear stresses and deviation angle α and azimuthal angle β. Appendix A of McLean and Addes lists the equations necessary to compute such a transformation between coordinate systems. SPE paper 20405 is hereby incorporated by reference in its entirety. Alternative transformation equations known to those skilled in rock mechanics may also be use to convert between principal stresses and rotated non-principal stress coordinate systems. Also, many commercial software programs for wellbore stability, such as GeoMechanics International's SFIB™ software and Advanced Geotechnology STABView™ software, can be used to transform principal stresses to alternative stresses and shear stresses in other coordinate systems given a deviation angle α and azimuthal angle β.

III. Edge Effects and Bottom Hole Stresses

The most simplified Skemptom approach to prediction of altered PP in expanded impermeable rock in the depth of cut zone at the bottom of a bore hole treats the depth of cut zone across the entire hole bottom as one element in which one ($\sigma_z$) of three independent orthogonal stresses has been changed and the other two have not. See equation (16). The one stress $\sigma_z$ assumed to be changed is acting normal to the bottom of the hole, and the change is represented by the difference between the earth stress acting normal to bottom of the hole and the mud or ECD pressure. An analogy or example is a cube with three independent orthogonal stresses acting normal to the sides of the cube, and then changing just one of those stresses while holding the other two constant. The bottom of the borehole is not quite this simple, and this is due primarily to two reasons. One is bottom hole profile created by a particular drill bit configuration and the other is edge effect which creates a stress concentration or stress riser. The most simplified approach of the present invention described above does not take into account the effect of a non-flat hole bottom nor the effect of stress concentrations which may occur near the diameter of the hole.

For the sake of simplicity, the following discussion, except where noted, will assume the case of a vertical well and normal earth stress environment, where overburden is significantly greater than both earth principal horizontal stresses and PP, and both earth principal horizontal stresses are approximately equal to one another. Those skilled in the art will appreciate that this case can be expanded to using all three orthogonal stresses and to deviated wellbores if so desired.

The rock in the depth of cut zone will have slightly different stress states throughout the leading profile of the wellbore, as will be described in greater detail below. Accordingly, CCS is the average apparent CCS of rock to the drill bit applied over the profile of the bottom of the wellbore. It is this value of CCS which can then be utilized with various algorithms that rely upon an accurate prediction of CCS.

A. Edge Effect

Immediately inside the diameter of the borehole, earth stress acting on the rock has been replaced by mud pressure. Immediately outside the diameter, overburden is still acting as the vertical stress. So, at the vicinity of the borehole diameter, the rock experiences an increase in vertical stress acting on it over the distance from just inside to just outside the diameter. In the classic example of a vertical well where mud pressure is significantly less than overburden, the result is the transfer of some of the stress in the higher stressed region Oust outside the diameter) to the lower stressed region Oust inside the diameter). The result of this is less expansion of rock near the diameter than near the center of the hole bottom, and the net result is less PP decrease in the less expanded rock near the diameter. This result is depicted in FIG. 4. The pressure differential curves decrease near the diameter as $R/R_w$ value increases. A representation of the error is indicated by the difference in values of associated pairs of curves. Note that FIG. 4 should not be used as an indication of the amount of error in general, as Warren and Smith's curves are for rock that is relatively stiff—most shales are less stiff and the error would be less.

B. Hole Profile

Again consider the case of a vertical well and normal earth stress environment, where overburden is significantly greater than both earth principal horizontal stresses and PP. A non-flat profile will result in altered stresses and expansion that is different from the above described simplified Skempton approach. This simplified Skempton approach assumes that horizontal stresses acting on the bottom of the hole are essentially the same as earth horizontal stresses. If the bottom of the hole is not flat, however, the horizontal stress on the rock in the depth of cut zone will be influenced by mud pressure. It is common for the center of the hole to be slightly raised with the shape of a cone or dome. This is slight to non-existent with roller cone bits and can be more pronounced with fixed cutter bits (PDC, Diamond, and Impregnated bits). As the cone/dome increases in height (or more correctly, as the side slopes or aspect ratio of the cone/dome increase), the dominant confining stress will transition from earth horizontal stress (for a flat bottom) to mud pressure. This would mean that all three terms ($\Delta\sigma_1$, $\Delta\sigma_2$ and $\Delta\sigma_3$) or ($\Delta\sigma_x$, $\Delta\sigma_y$ and $\Delta\sigma_z$) of the Skempton formula are non-zero. As an extreme example, a very pointed cone similar in shape to the point of a pencil may be considered. Obviously, the influence of any earth stress at the tip is very small—the tip will be under the stress of the mud pressure and very little else, and the influence of earth stresses will be nonexistent to very low from the tip to near the base of the cone, at which point earth stress would start to influence.

Finite element or computer modeling can be performed to better predict actual net effective stress changes as a function of profile, rock properties, earth stresses, and mud stresses. These results can be compared to the simplified Skempton method utilized in the preferred exemplary embodiment of this invention. Corrections may be determined which can be applied to the simplified Skempton approach described above to arrive at a more accurate average apparent CCS of rock to the drill bit applied over the profile of the bottom of the wellbore. Of course, this assumes the finite element method correctly models the real case in the rock's depth of cut zone.

An example of this type of comparison is depicted by FIG. 4 where the ΔPP of the finite element result (reported by Warren and Smith) is compared to the ΔPP of the simplified Skempton results using the present methodology of this invention. This may represent one form of a very simple comparison, analogous to the vertical hole example and in which earth horizontal stresses are equal. In this case, the earth stresses acting parallel to the plane of the bottom of the hole are equal and a 2D axisymmetric finite element model can be used (as Warren and Smith reported). Assuming the finite element approach represents the correct solution and to determine the correction required to the simplified Skempton method, the ΔPP result of the finite element model and the ΔPP result of the simplified Skempton method can be integrated over the circular area to determine the net average ΔPP for the entire area (the entire hole bottom) for each method. These integrated net average ΔPP results are then used to quantitatively establish the difference between the two sets of results. Subsequently, a correction factor can be derived relating the results of the finite element modeling with the Skempton approach of the present invention. For example, if the finite element ΔPP function integrated over a circular area from 0 to $R_w$ is 45 units and the simplified Skempton ΔPP function integrated over the same area is 57 units, then the correction factor CF would be 45/57 or 0.788. That is, $$\Delta PP = CF \times \Delta PP = 0.788 \times \Delta PP. \tag{26}$$

For the case of a deviated well or where earth stresses acting parallel to the plane of the bottom of the hole vary, a 3D finite element model may be required for arrive at the appropriate correction factor. In this case, the difference in ΔPP of a 3D finite element result and the simplified Skempton method will be dependant upon radial distance from the center of the hole (i.e. the $R/R_w$ value as used by Warren and Smith) and the direction from center of the hole. In lieu of a 3D finite element approach, it may be adequate to average the stresses acting parallel to the plane of the bottom of the hole and then apply the 2D correction factor methodology (described above). 3D modeling may reveal that this approach is of sufficient accuracy.

In the approaches outlined above, the correction coefficients CF are for average ΔPP for the area of the hole bottom. This approach simply multiplies the average ΔPP result of the simplified Skempton method by the correction coefficient CF. In order to develop correction factors CF for all bit types, "standard" or "typical" profiles are established for the various bit types and these profiles are used in finite element modeling, with the average ΔPP result of the finite element method used to establish the "correct" answer and correction coefficients CF are applied to the simplified Skempton method. It may be that using an "average net ΔPP" for the hole bottom may present another error. For example, bit experts generally agree that most of the work in drilling the bore hole is done at the outer third of the diameter of the hole, and that the rock in the center is relatively easy to destroy. As evidence of this theory, bit designers typically focus priority on the outer half to two-thirds of the bit profile, and the inner third is of secondary importance and typically is a compromise that must adapt to the outer portion of the bit. It may be that this is simply an "area" factor, and, if so, using an average net ΔPP may be appropriate and approximately accurate. However, if it is due to other phenomena not addressed by the various corrections suggested in this specification, then it may be that particular regions of the bottom of the hole, according to region diameter range, may have to be "weighted" to indicate greater or lesser influence. Again, finite element models can be used to establish weights associated with the appropriate diameter range. Further, various hole sizes could be modeled to determine the effect of hole size, if any, and how to scale results from one hole size to another.

Alternatively, a "suite" of profiles that spans the spectrum of the "typical" profiles may be "built" and then modeled, and this provides a "catalog" of results that could be referenced and an interpolation applied for any profile. In order to reduce the number of possible profiles, breaking the hole bottom into regions may be used. For example, regions may be inner radial third, middle radial third, and outer radial third, but it is recognized that other divisions may be warranted. If this approach is taken, regions can be defined by a radius range (as opposed to area). From a catalog of profiles for each region, a composite (complete) profile is assigned for each bit type. For example, for bit type XYZ, the best representative profile might be ACB, where A, C, and B represent profiles available from a catalog of profiles for inner, middle, and outer thirds. An exemplary chart of such profile combinations for the various radius segments is illustrated by Table 2 found in FIG. 9.

As indicated by the results of FIG. 4, rock properties and values of PP and earth stresses influence the result and the difference in results between finite element modeling and the simplified Skempton method. As such, a range of PP and earth stresses can be modeled to develop another correction factor for "environment". Likewise, a range of rock properties can be modeled to develop a correction factor CF for "rock properties". Whether it is environment or rock properties, the required data can be integrated into rock mechanics software as these data are required for normal workflows.

In a preferred embodiment, the present modified Skempton approach may include using one or more of several correction factors CF—one for profile, one for hole size, one for rock properties, one for environment and so forth. The correction factor profile corrects for the difference between a flat bottom (the assumption for the simplified Skempton method) and the actual profile and edge effects at the diameter. The correction factor for hole size corrects for a hole size larger or smaller than a baseline size or model. The correction factor for rock properties corrects for the influence of stiffness, bulk compressibility, pore fluid compressibility, shear strength, Poisson's ratio, permeability, or whatever other factors are deemed to be pertinent. The correction factor for environment corrects for influence of stress magnitudes and differences between mud pressure, pore pressure, overburden, and earth stresses. This results in the following equation for a vertical well:

$$\text{Skempton } PP_{corrected}=PP-[(OB-ECD)/3]*CF \quad (27)$$

where: $CF=(CF_{profile})*(CF_{hole\ size})*(CF_{rock\ properties})*(CF_{environment})$ and:

$CF_{profile}$=function of bit type (steel tooth, Insert, 3-4 blade PDC, etc)

$CF_{hole\ size}$=function of hole size $CF_{rock\ properties}$=function of rock properties, as required $CF_{environment}$=function of OB, PP, $\sigma_2$, $\sigma_3$, mud pressure, deviation, and azimuth.

It may be that the approach of not accounting for edge effects and hole profile is the primary cause of apparent sources of errors with the exception of rock and pore fluid properties. If so a methodology to correct for bottom hole profile and edge effects, and rock and pore fluid properties, may be sufficiently accurate. Regarding correction factors for rock and pore fluid properties, a direct solution based on fundamental principles and using rock and fluid properties may be used. An appropriate PP algorithm would then be a function of one or more rock and fluid properties. This results in the following equation for a vertical well:

$$\text{Skempton } PP_{corrected}=PP-[(OB-ECD)/3]*(\text{function of rock properties, and fluid properties } a, b, c, \text{ etc})*CF \quad (28)$$

and:

$CF=CF_{profile}$=function of bit type (steel tooth, Insert, 3-4 blade PDC, etc).

Application of CCS to Drilling Problems

The above values for CCS may be used in various algorithms to calculate drill bit related properties. By way of example and not limitation, CCS could be used for pre-drill bit selection, ROP prediction, and bit life prediction. Furthermore it is envisioned that CCS estimates using the above methodologies could further be used in other areas. Examples include inclusion of CCS in predicting drillstring dynamics and quantitative analysis of drilling equipment alternatives. CCS provides one of the fundamental and necessary inputs for both. Drillstring dynamics refers to the dynamic behavior of drillstrings. That is, how much does the drillstring compress, twist, etc., as bit weight is applied and bit torque is generated, as well as when the excitation forces transmitted through the drill bit coincide and/or induce natural resonating vibrational frequencies of the drillstring. These vibrational modes may be lateral, whirl, axial, or stick-slip (stick-slip refers to the condition of repeated cycles of torque and twist building and then releasing in a drillstring). In general, it is advantageous to avoid vibrational modes, so prediction of these can prove useful and valuable. Quantitative analysis of drilling equipment alternatives refers to prediction of ROP and bit life prediction for various bit types and for various drilling equipment capabilities. For example, the predicted time and cost to drill a well with various rig sizes/capabilities can be calculated and compared, and then the results of the comparison used to make more intelligent equipment selection for accomplishing desired business objectives. There is not presently a quantitative and robust way to make such predictions; however, using the CCS estimates as described above, such predictive capability for various drill bits and equipment combinations may be made.

While in the foregoing specification this invention has been described in relation to certain preferred embodiments thereof, and many details have been set forth for purposes of illustration, it will be apparent to those skilled in the art that the invention is susceptible to alteration and that certain other details described herein can vary considerably without departing from the basic principles of the invention.

Nomenclature $\Delta\sigma_1$, $\Delta\sigma_2$, $\Delta\sigma_3$=changes in the three principal orthogonal stresses $\Delta\sigma_X$=change in bottom hole stress normal to axis of wellbore, psi $\Delta\sigma_Y$=change in bottom hole stress normal to axis of wellbore, psi $\Delta\sigma_Z$=change in bottom hole stress parallel to axis of wellbore, psi ΔPP=change in pore pressure, psi or ppg equivalent A=Skempton coefficient, dimensionless B=Skempton coefficient, dimensionless $CCS_{HP}$=Confined Compressive Strength, psi, based on $DP_{HP}$ $CCS_{ECD}$=Confined Compressive Strength, psi, based on $DP_{ECD}$ $CCS_{LP}$=Confined Compressive Strength, psi, based on $DP_{LP}$ DP=(ECD pressure−PP), psi $DP_{ECD}$=ECD pressure, psi $DP_{LP}$=[ECD−{PP−(OB−ECD)/3}], psi ECD=Equivalent Circulating Density, ppg ECD Pressure=pressure in psi exerted by an ECD in ppg FA=Rock Internal Angle of Friction, degrees OB=Overburden, psi or ppg $\phi_e$=Effective Porosity (porosity of non-shale fraction of rock multiplied by the fraction of non-shale rock), Volume per Volume, "fraction", or percent PP=pore pressure, psi or ppg ppg=pounds per gallon $ROP_{HP}$=Rate of penetration, ft/hr, based on $CCS_{HP}$ $ROP_{LP}$=Rate of penetration, ft/hr, based on $CCS_{LP}$ $ROP_{ECD}$=Rate of penetration, ft/hr, based on $CCS_{ECD}$ UCS=Rock Unconfined Compressive Strength, psi

What is claimed is:

1. A method for predicting drilling performance, the method comprising the steps of:

a) determining unconfined compressive strength (UCS) for a rock in a depth of cut zone of a subterranean formation which is to be drilled using a drill bit and drilling fluid;

b) determining the change in the strength of the rock due to applied stresses which will be imposed on the rock during drilling including the change in strength due to change in pore pressure (ΔPP) in the rock due to drilling;

c) determining confined compressive strength (CCS) for the rock in the depth of cut zone by adding the estimated change in strength to the UCS; and d) predicting drilling performance based on the CCS for the rock in the depth of cut zone.

2. The method of claim 1 wherein:

the ΔPP is estimated assuming that there will be no substantial movement of fluids into or out of the rock during drilling.

3. The method of claim 2 wherein:

the rock has an effective porosity of less than a predetermined porosity threshold such that there will be no substantial movement of fluids into or out of the rock during drilling.

4. The method of claim 3 wherein:

the predetermined porosity threshold is 0.05 or less.

5. The method of claim 1 wherein:

the rock has an effective porosity of less than a predetermined threshold.

6. The method of claim 1 wherein:

the ΔPP in the rock is calculated in accordance with the following mathematical expression:

$$\Delta PP = B[(\Delta\sigma_x + \Delta\sigma_y + \Delta\sigma_z)/3 + \sqrt{\frac{1}{2}[(\Delta\sigma_x - \Delta\sigma_y)^2 + (\Delta\sigma_x - \Delta\sigma_z)^2 + (\Delta\sigma_y - \Delta\sigma_z)^2] + 3\Delta\tau_{xy}^2 + 3\Delta\tau_{yz}^2 + 3\Delta\tau_{xz}^2}\,*(3A-1)/3]; \quad (25)$$

where: A=Skempton coefficient that describes change in pore pressure caused by change in shear stress on the rock;

B=Skempton coefficient that describes change in pore pressure caused by change in mean stress on the rock;

Δ=operator describing the difference in a particular stress on the rock before drilling and during drilling;

$\sigma_x$=stress in the x-direction;

$\sigma_y$=stress in the y-direction;

$\sigma_z$=stress in the z-direction;

$T_{xy}$=shear stress in the x-y plane;

$T_{yz}$=shear stress in the y-z plane; and $T_{xz}$=shear stress in the x-z plane.

7. The method of claim 1 wherein:

the ΔPP in the rock is calculated in accordance with the following mathematical expression:

$$\Delta PP=B[(\Delta\sigma_x+\Delta\sigma_y+\Delta\sigma_z)/3+\sqrt{\tfrac{1}{2}[(\Delta\sigma_1-\Delta\sigma_2)^2+(\Delta\sigma_1-\Delta\sigma_3)^2+(\Delta\sigma_2-\Delta\sigma_3)^2]}*(3A-1)/3];$$

where: A=coefficient that describes change in pore pressure caused by change in shear stress on the rock;

B=coefficient that describes change in pore pressure caused by change in mean stress on the rock;

Δ=operator describing the difference in a particular stress on the rock before drilling and during drilling;

$\sigma_1$=first principal stress on the rock;

$\sigma_2$=second principal stress on the rock; and $\sigma_3$=third principal stress on the rock.

8. The method of claim 1 wherein:

the ΔPP in the rock is calculated in accordance with the following mathematical expression:

$$\Delta PP=B[(\Delta\sigma_1+\Delta\sigma_2+\Delta\sigma_3)/3+(\Delta\sigma_1-\Delta\sigma_3)*(3A-1)/3]$$

where: A=coefficient that describes change in pore pressure caused by change in shear stress in the rock;

B=coefficient that describes change in pore pressure caused by change in mean stress in the rock;

$\Delta\sigma_1$=change in the first principal stress acting upon the rock due to drilling;

$\Delta\sigma_2$=change in the second principal stress acting on the rock due to drilling; and $\Delta\sigma_3$=change in the third principal stress acting on the rock due to drilling.

9. The method of claim 1 wherein:

the ΔPP in the rock is calculated in accordance with the following mathematical expression:

$$\Delta PP=B(\Delta\sigma_1+\Delta\sigma_2+\Delta\sigma_3)/3$$

where: B=coefficient that describes change in pore pressure caused by change in mean stress in the rock;

$\Delta\sigma_1$=change in the first principal stress acting upon the rock due to drilling;

$\Delta\sigma_2$=change in the second principal stress acting on the rock due to drilling; and $\Delta\sigma_3$=change in the third principal stress acting on the rock due to drilling.

10. The method of claim 1 wherein:

the ΔPP in the rock is calculated in accordance with the following mathematical expression:

$$\Delta PP=B(\Delta\sigma_x+\Delta\sigma_y+\Delta\sigma_z)/3$$

where: B=coefficient that describes change in pore pressure caused by change in mean stress in the rock;

$\Delta\sigma_z$=change in the stress acting in the direction of the wellbore due to drilling;

$\Delta\sigma_x$=change in the stress acting in a first direction perpendicular to the wellbore due to drilling; and $\Delta\sigma_y$=change in the stress acting in a second direction orthogonal to both the wellbore and the first direction due to drilling.

11. The method of claim 1 wherein:

the ΔPP in the rock is calculated in accordance with the following mathematical expression:

$$\Delta PP=B(\Delta\sigma_z)/3$$

where: B=coefficient that describes change in pore pressure caused by change in mean stress in the rock; and $\Delta\sigma_z$=change in the stress acting in the direction of the wellbore between before and during drilling.

12. The method of claim 1 wherein:

the ΔPP in the rock is calculated in accordance with the following mathematical expression:

$$\Delta PP=(\Delta\sigma_z)/3$$

where: $\Delta\sigma_z$=change in the stress acting in the direction of the wellbore due to drilling.

13. The method of claim 1 wherein:

the CCS is calculated in accordance with the following mathematical expression:

$$CCS=UCS+f(DP);$$

where: UCS=the unconfined compressive strength of the rock;

DP=differential pressure acting upon the rock and is a function of the change in pore pressure ΔPP; and f(DP)=a mathematical function of DP.

14. The method of claim 1 wherein:

the CCS is calculated in accordance with the following mathematical expression:

$$CCS=UCS+DP+2DP\sin FA/(1-\sin FA);$$

where: UCS=the unconfined compressive strength of the rock;

DP=differential pressure acting upon the rock and is a function of the change in pore pressure ΔPP; and FA=internal angle of friction of the rock.

15. The method of claim 13 wherein:

the DP, is calculated according to:

$$DP=ECD\ \text{pressure}-(PP+\Delta PP);$$

where: ECD pressure=pressure exerted by drilling fluid under circulating conditions in the direction of drilling;

PP=in situ pore pressure of the rock prior to drilling; and

ΔPP=change in pore pressure in the rock due to drilling.

16. The method of claim 13 wherein:

the DP is estimated in accordance with the following mathematical expression:

$$DP=ECD-(PP-(\sigma_z-ECD)/3);$$

where: ECD=pressure exerted by drilling fluid under circulating conditions;

PP=in situ pore pressure of the rock prior to drilling; and $\sigma_z$=in situ stress in the direction of the wellbore which is removed from the rock due to drilling.

17. The method of claim 13 wherein:

the DP is calculated in accordance with the following mathematical expression:

$$DP=ECD-(PP-(OB-ECD)/3);$$

where: ECD=pressure exerted by the drilling fluid under circulating conditions;

PP=in situ pore pressure of the rock prior to drilling; and

OB=in situ overburden (vertical) stress prior to drilling.

18. The method of claim 1 wherein:

the change in strength is estimated based upon removal of stress from the rock due to removal of overburden, the pressure applied to the rock due to the drilling fluid (ECD pressure), the in situ PP of the rock prior to drilling, and of the internal angle of friction FA of the rock.

19. The method of claim 1 wherein:

the change in strength is calculated based at least partially on the deviation angle α a of the wellbore to be drilled.

20. The method of claim 19 wherein:

the ΔPP in the rock is calculated in accordance with the following mathematical expression:

$$\Delta PP=B(\Delta\sigma_x+\Delta\sigma_y+\Delta\sigma_z)/3$$

where: B=coefficient that describes change in pore pressure caused by change in mean stress in the rock $\Delta\sigma_z$=change in the stress acting in the direction of the wellbore due to drilling;

$\Delta\sigma_x$=change in the stress acting in a first direction perpendicular to the wellbore due to drilling; and $\Delta\sigma_y$=change in the stress acting in a second direction orthogonal to both the wellbore and the first direction due to drilling; and $\sigma_x$, $\sigma_y$, and $\sigma_z$ are calculated by:

(i) determining the principal stresses $\sigma_1$, $\sigma_2$, and $\sigma_3$ acting on the rock before and during drilling; and (ii) transposing the principal stresses $\sigma_1$, $\sigma_2$, and $\sigma_3$ into normal stresses $\sigma_x$, $\sigma_y$, and $\sigma_z$ using transformation equations based on the deviation angle α of the wellbore.

21. The method of claim 1 wherein:

the CCS is determined in part based upon the bottom hole profile of the wellbore being drilled.

22. The method of claim 1 wherein predicting drilling performance comprises predicting drillstring dynamics.

23. The method of claim 1 wherein predicting drilling performance comprises selecting a drill bit for drilling the rock in the depth of cut zone of the subterranean formation based on the CCS for the rock in the depth of cut zone.

24. A method for predicting drilling performance, the method comprising the steps of:

a) determining unconfined compressive strength (UCS) for a rock in a depth of cut zone of a subterranean formation which is to be drilled using a drill bit and a drilling fluid;

b) estimating the change in the strength of the rock based at least in part upon change in pore pressure (ΔPP) of the rock resulting from changes in the volume of the pores of the rock due to changes in confining stresses applied upon the rock due to drilling and due to fluid movement into and out of the pores of the rock in response to the drilling of the wellbore with a drill bit and drilling fluid;

c) estimating confined compressive strength (CCS) for the rock in the depth of cut zone by adding the estimated change in strength to the UCS; and d) predicting drilling performance based on the CCS for the rock in the depth of cut zone.

25. The method of claim 24 wherein:

it is estimated that there is no substantial movement of fluid into and out of the pores of the rock.

26. The method of claim 25 wherein:

the estimation that there is no substantial movement of fluid into and out of the pores of the rock is based upon the rock having an effective porosity ($\phi_e$ of less than a predetermined effective porosity threshold.

27. The method of claim 24 wherein:

it is estimated that there is there is limited movement of fluid into and of the pores of the rock.

28. The method of claim 24 wherein:

estimates of CCS are made for high permeability rock, low permeability rock and for rock having a permeability intermediate to the high and low permeability rocks.

29. The method of claim 28 wherein:

the CCS of the rock in the depth of cut zone is calculated according to the following mathematical expression:

$$CCS=UCS+f(DP)$$

where: UCS=Unconfined Compressive Strength of the rock in the depth of cut zone;

DP=differential pressure acting upon the rock in the depth of the cut zone; and f(DP)=a mathematical function of DP.

30. The method of claim 29 wherein:

$$DP=ECD-PP$$

where: ECD=equivalent circulating density of the drilling fluid; and

PP=the in situ pore pressure (PP) of rock prior to drilling.

31. The method of claim 30 wherein:

calculating the change in the strength is a function of the deviation angle $\alpha$ of the wellbore.

32. The method of claim 24 wherein predicting drilling performance comprises predicting drillstring dynamics.

33. The method of claim 24 wherein predicting drilling performance comprises selecting a drill bit for drilling the rock in the depth of cut zone of the subterranean formation based on the CCS for the rock in the depth of cut zone.

34. A method for predicting drilling performance, the method comprising the steps of:

(a) estimating confined compressive strength (CCS) for substantially permeable rock ($CCS_{HP}$) in accordance with the following mathematical formula:

$$CCS_{HP}=UCS+f(DP);$$

where: UCS=the unconfined compressive strength of the rock;

DP=differential pressure acting upon the rock; and f(DP)=a mathematical function of DP;

(b) estimating the CCS for substantially impermeable rock ($CCS_{LP}$) in accordance with the following mathematical expression:

$$CCS_{LP}=UCS+f(DP);$$

where: UCS=the unconfined compressive strength of the rock;

DP=differential pressure acting upon the rock and is a function of change in pore pressure ($\Delta$PP); and f(DP)=a mathematical function of DP;

(c) calculating an intermediate CCS ($CCS_{mix}$) for the rock based upon the estimated permeability of the rock and the confined compressive strengths $CCS_{HP}$, $CCS_{LP}$ for substantially permeable and impermeable rocks; and d) predicting drilling performance based on the $CCS_{mix}$ for the rock.

35. The method of claim 34 wherein:

the estimated permeability of the rock is based upon the effective porosity of the rock.

36. The method of claim 35 wherein:

the intermediate CCS ($CCS_{MIX}$) is calculated in accordance with the followings mathematical expressions:

$$CCS=CCS_{HP} \text{ if } \phi_e \geqq \phi_{HP},$$

$$CCS=CCS_{LP} \text{ if } \phi_e \leqq \phi_{LP},$$

$$CCS_{MIX}=CCS_{LP}\times(\phi_{HP}-\phi_e)/(\phi_{HP}-\phi_{LP})+CCS_{HP}\times(\phi_e-\phi_{LP})/(\phi_{HP}-\phi_{LP}) \text{ if } \phi_{LP}<\phi_e<\phi_{HP};$$

where: $\phi_e$=effective porosity;

$\phi_{LP}$=low effective porosity; and $\phi_{HP}$=high effective porosity.

37. The method of claim 34 wherein predicting drilling performance comprises predicting drillstring dynamics.

38. The method of claim 34 wherein predicting drilling performance comprises selecting a drill bit for drilling the rock based on the $CCS_{MIX}$ for the rock.

39. A method for predicting drilling performance, the method comprising:

(a) calculating a baseline change in core pressure ($\Delta$PP) using a baseline mathematical formula;

(b) determining a $\Delta$PP for the rock and drilling environment utilizing a computer model of the rock and drilling conditions based upon at least one characteristic of the rock, drilling conditions, and drill bit;

(c) determining a correction factor CF between baseline $\Delta$PP and the $\Delta$PP of the computer model;

(d) determining a $\Delta$PP in another rock utilizing the baseline formula and the correction factor CF;

(e) determining confined compressive strength (CCS) using the $\Delta$PP determined in step (d); and (f) predicting drilling performance based on the CCS.

40. The method of claim 39 wherein:

the correction factor CF is one of the characteristics selected from the group comprising:

$CF_{profile}$=function of bit type;

$CF_{hole\ size}$=function of hole size;

$CF_{rock\ properties}$=function of rock properties;

$CF_{environment}$=function of one of OB, PP, hmin, hmax, ECD, angle of deviation $\alpha$, and azimuth $\beta$.

41. The method of claim 39 wherein predicting drilling performance comprises predicting drillstring dynamics.

42. The method of claim 39 wherein predicting drilling performance comprises selecting a drill bit based on the CCS.

43. A method of predicting drilling performance, the method comprising the steps of:

(a) calculating, utilizing a mathematical expression, a baseline differential pressure (DP) across a rock in a depth of cut zone for a drill bit having a baseline profile under a baseline set of drilling conditions;

(b) computing, using a computer model, the DP across the rock in the depth of cut zone for a drill bit having a first profile differing from that of the baseline profile under the baseline set of drilling conditions;

(c) calculating a profile correction factor by comparing the baseline DP with the DP determined from the computer model;

(d) calculating a corrected DP, utilizing the mathematical expression and the profile correction factor, for a drill bit with the first profile baseline set of drilling conditions;

(e) determining confined compressive strength (CCS) using the corrected DP; and (f) predicting drilling performance based on the CCS.

44. The method of claim 43 wherein:

profile correction factors are calculated for a number of drill bits having differing profile; and a number of corrected differential pressures are calculated utilizing respective profile correction factors corresponding to the drill bits.

45. The method of claim 43 wherein predicting drilling performance comprises predicting drillstring dynamics.

46. The method of claim 43 wherein predicting drilling performance comprises selecting a drill bit for drilling the rock in the depth of cut zone based on the CCS.

* * * * *